US008869535B2

(12) United States Patent
Koch et al.

(10) Patent No.: US 8,869,535 B2
(45) Date of Patent: Oct. 28, 2014

(54) TURBINE BURNER HAVING PREMIXING NOZZLE WITH A SWIRLER

(75) Inventors: Boris Ferdinand Koch, Ratingen (DE); Berthold Köstlin, Duisburg (DE); Bernd Prade, Mülheim (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 13/699,801

(22) PCT Filed: Mar. 29, 2011

(86) PCT No.: PCT/EP2011/054777

§ 371 (c)(1), (2), (4) Date: Nov. 26, 2012

(87) PCT Pub. No.: WO2011/157458

PCT Pub. Date: Dec. 22, 2011

(65) Prior Publication Data

US 2013/0074506 A1 Mar. 28, 2013

(30) Foreign Application Priority Data

Jun. 18, 2010 (EP) ..... 10166431

(51) Int. Cl.

| | |
|---|---|
| ***F02C 1/00*** | (2006.01) |
| ***F02G 3/00*** | (2006.01) |
| ***F23M 9/00*** | (2006.01) |
| ***F23R 3/34*** | (2006.01) |
| ***F23R 3/36*** | (2006.01) |

(52) U.S. Cl.

CPC ..... *F23R 3/36* (2013.01); *F23D 2900/14021* (2013.01); *F23R 3/343* (2013.01); *F23D 2900/00008* (2013.01); *F23R 2900/00002* (2013.01); *F23D 2900/00014* (2013.01)

USPC ..... 60/748; 60/737; 60/740; 431/183

(58) Field of Classification Search

CPC ..... F23R 3/286; F23R 3/14; F23R 3/36; F23C 7/0004

USPC ..... 60/737, 748, 740, 746; 239/419; 431/183

See application file for complete search history.

(56) References Cited

U.S. PATENT DOCUMENTS 5,451,160 A * 9/1995 Becker ..... 431/284
8,104,285 B2 * 1/2012 Bonzani et al. ..... 60/748

(Continued)

FOREIGN PATENT DOCUMENTS

CN 1158383 A 9/1997
DE 19757617 A1 3/1999

(Continued)

OTHER PUBLICATIONS

ProQuest, UMI 3348149, 2009 ProQuest p. 151.*

(Continued)

*Primary Examiner* — Phutthiwat Wongwian
*Assistant Examiner* — William Breazeal

(57) ABSTRACT

A turbine burner is provided. The turbine burner has a secondary feed unit and a primary feed unit. The primary feed unit has a primary mixing tube and a fuel nozzle that are arranged concentrically around the secondary feed unit. The primary mixing tube and the fuel nozzle have a fluid flow connection. The fuel nozzle has an annular wall that is radially spaced in the axial direction from the secondary feed unit such that a gap height is fainted by the annular wall and the secondary feed unit. The annular wall has an inside wall directed toward the secondary feed unit and having blades with a leading edge on the upstream side. The fuel nozzle has an inlet and the blades have an axial distance from the inlet. The ratio of the distance to the gap height is greater than 1 and less than the gap height.

13 Claims, 2 Drawing Sheets

(56) References Cited

U.S. PATENT DOCUMENTS

| | | | | |
|---|---|---|---|---|
| 2009/0025394 | A1* | 1/2009 | Bonzani et al. | 60/748 |
| 2010/0313569 | A1* | 12/2010 | Boardman et al. | 60/737 |

FOREIGN PATENT DOCUMENTS

| | | | |
|---|---|---|---|
| EP | 1649219 | B1 | 5/2008 |
| WO | WO 9904196 | A1 | 1/1999 |
| WO | WO 2006053866 | A1 | 5/2006 |
| WO | WO 2007053323 | A2 | 5/2007 |

OTHER PUBLICATIONS

Linck, Combustion Characteristics of Pressurized Swirling Spray Flame and Unsteady Two Phase Exhaust Jet, 2006, AIAA, p. 4.*

Zhaorui Li, 2009, Modeling and Simulation of Turbulent Multiphase Flows, ProQuest/UMI Dissertation Publishing, UMI Microform 3348149, ISBN10 110903671, ISBN 13 97811090367, p. 151.*

* cited by examiner

TURBINE BURNER HAVING PREMIXING NOZZLE WITH A SWIRLER

CROSS REFERENCE TO RELATED APPLICATIONS

This application is the US National Stage of International Application No. PCT/EP2011/054777 filed Mar. 29, 2011 and claims the benefit thereof. The International Application claims the benefits of European application No. 10166431.6 filed Jun. 18, 2010, both of the applications are incorporated by reference herein in their entirety.

FIELD OF THE INVENTION

The invention relates to a turbine burner.

BACKGROUND OF THE INVENTION

Compared with the traditional gas turbine fuels of natural gas and crude oil, which consist predominantly of hydrocarbon compounds, the combustible constituents of synthesis gases are substantially CO and H2. Depending on the gasification method and overall plant concept the heating value of the synthesis gas is approximately 5 to 10 times less than the heating value of natural gas. Principal constituents in addition to CO and H2 are inert fractions such as nitrogen and/or water vapor and in certain cases also carbon dioxide. Due to the low heating value it is accordingly necessary to supply gaseous fuel through the burner to the combustion chamber at high volumetric flow rates. The consequence of this is that one or more separate fuel passages must be made available for the combustion of low-calorie fuels such as e.g. synthesis gas. Due to the high reactivity (high flame velocity, large flammability range) of synthesis gases compared to conventional fuels such as natural gas and oil there is a significantly higher risk in respect of flame flashback, which is to say burner damage. For this reason the current practice in industrial gas turbines is to combust synthesis gases exclusively in the diffusion mode of operation. The local high combustion temperatures associated therewith lead to high nitrogen oxide emissions, which are in turn lowered by an additional dilution by means of inert substances such as N2 or water vapor. The additional increase in the fuel mass flow rate associated therewith in turn imposes special requirements on the combustion system and the front-end auxiliary systems.

In the burner according to the prior art—such as described in EP 1 649 219 B1—the synthesis gas is supplied to the combustion chamber by way of an annulus passage arranged around the burner axis. In this case the gas upstream of the burner nozzle is conducted through a nozzle ring present in the burner nozzle and having boreholes inclined at an angle, a circumferential velocity component being applied to the gas. This means that in the prior art a relatively low Mach number is superimposed on the synthesis gas directly at the nozzle. Associated therewith there also exists, due to the low fuel momentum, only a relatively low intensity in terms of the mixing with the combustion air surrounding the annular fuel flow both internally and externally. An additional factor militating against rapid mixing of the fuel with the combustion air is the geometric embodiment of the annular gap with a relatively large gap width and correspondingly large mixing path.

The nozzle ring of EP 1 649 219 B1 having boreholes inclined at an angle was chosen in particular for synthesis gases having a relatively high heating value in order to achieve a sufficiently high pressure loss at the nozzle for acoustic stability, without substantially changing the main dimensions. However, this embodiment has aerodynamic disadvantages. Accordingly, discrete jets are generated which cannot be homogenized to a sufficient extent on the path available up to the burner outlet, thus leading to increased NOX emissions. Furthermore, a considerable total pressure loss occurs due to the flow separations inside and upstream of the nozzle, such that said lost momentum is subsequently not available as mixing energy.

SUMMARY OF THE INVENTION

It is therefore an object of the invention to disclose an improved burner having an improved fuel nozzle which leads to improved mixing and avoids the above-cited disadvantages.

This object is achieved by the disclosure of a turbine burner according to the independent claim. The dependent claims contain advantageous embodiments and developments of the invention.

The effect of the invention is that at the same swirl intensity a lower pressure loss is established compared with the nozzle ring of the nozzle according to the prior art. Furthermore, the effect of the blades is that, given the same overall pressure loss, a greater proportion of the pressure loss is placed at the fuel nozzle outlet, thus producing a higher level of acoustic stability in the combustion zone than in the case of the prior art nozzle.

BRIEF DESCRIPTION OF THE DRAWINGS

Further features, characteristics and advantages of the present invention will emerge from the following description of exemplary embodiments with reference to the attached FIGS. 1 and 2.

DETAILED DESCRIPTION OF THE INVENTION

Figure 1:
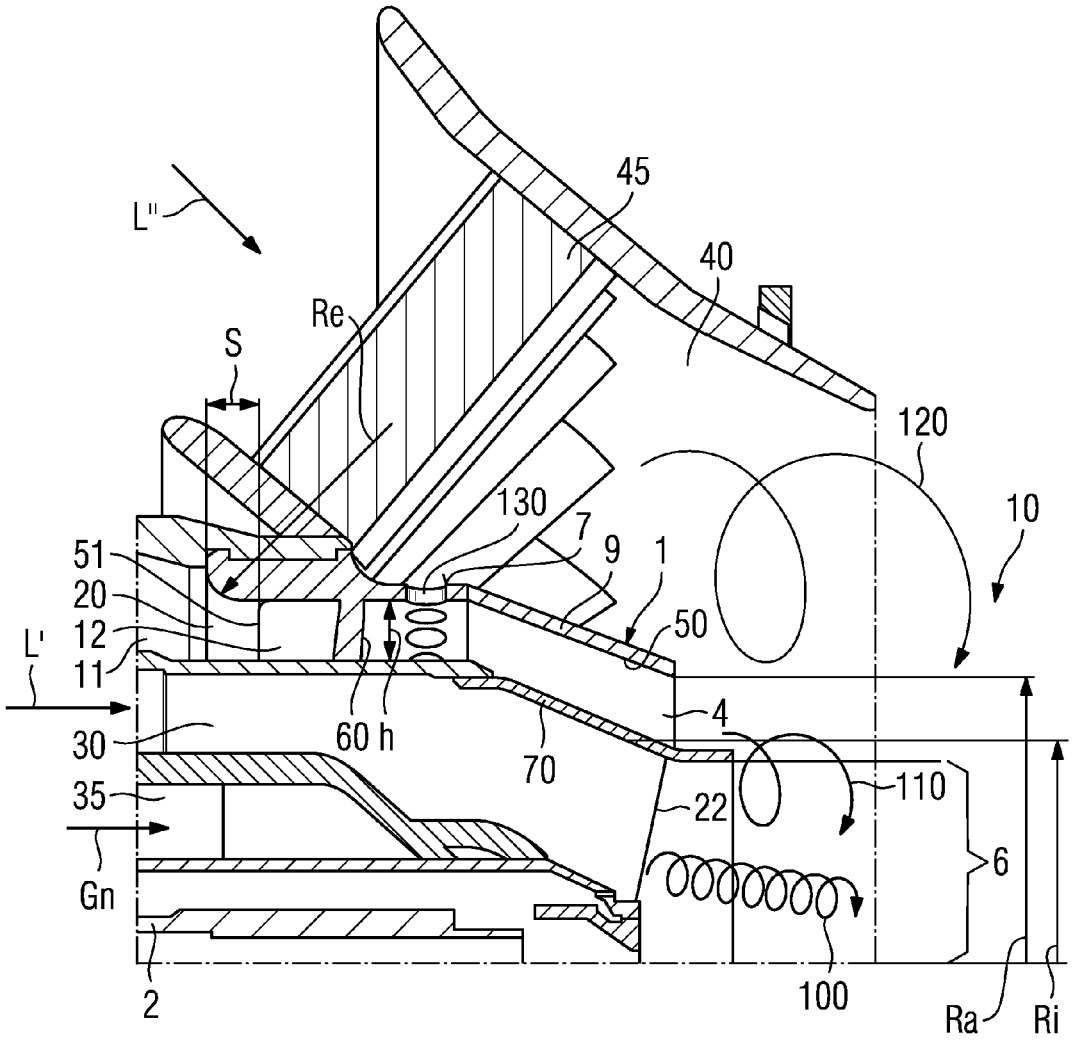
FIG. 1 shows such a turbine burner according to the invention.

The turbine burner according to FIG. 1 has a secondary feed unit for supplying a secondary fuel or air and for discharging the fuel or air from an orifice 6 into a combustion zone 10 auf. The secondary fuel can in this case comprise natural gas and air. The secondary feed unit has a radius Ri. The secondary feed unit can additionally include a pilot burner 2 which is designed for a further fuel e.g. oil. Moreover, a further natural gas duct 35 arranged annularly around the pilot burner 2 can be provided for supplying natural gas Gn. The natural gas can in this case be diluted with steam or water in order to keep the NOx values under control. The secondary feed unit can additionally provide a further annular air duct 30 into which compressor air L' flows. At the downstream end in this arrangement the secondary feed unit comprises at least one swirl generator, called an axial grating 22, for generating a swirl. In this case the axial grating 22 can be arranged at the downstream end of the air duct 30 of the secondary feed unit. The natural gas Gn of the duct 35 is caused to flow into the air duct 30 upstream of the axial grating 22. The thus resulting air-natural gas mixture is then swirled by means of the axial grating 22 before being introduced into the combustion zone 10.

The burner further comprises a primary feed unit which has a primary mixing tube 11 and a fuel nozzle 1 having an orifice pointing into the combustion zone at the fuel nozzle outlet 4 for the purpose of supplying a primary fuel, the fuel nozzle 1 and the primary mixing tube 11 being arranged concentrically around the secondary feed unit. In this arrangement the primary mixing tube 11 and the fuel nozzle 1 have a fluid flow connection. Synthesis gas is supplied through the primary mixing tube 11 and the fuel nozzle 1 to the combustion zone 10.

Arranged at least partially around the primary feed unit is an annular duct 40 which has a plurality of swirlers 45, with or without fuel nozzles, arranged over the circumference. Compressor air into which fuel can be injected by means of the swirlers 45, is forced through said annular duct 40. The compressor air L"-fuel mixture resulting therefrom or the air L" is likewise swirled before being introduced into the combustion zone 10.

Figure 2:
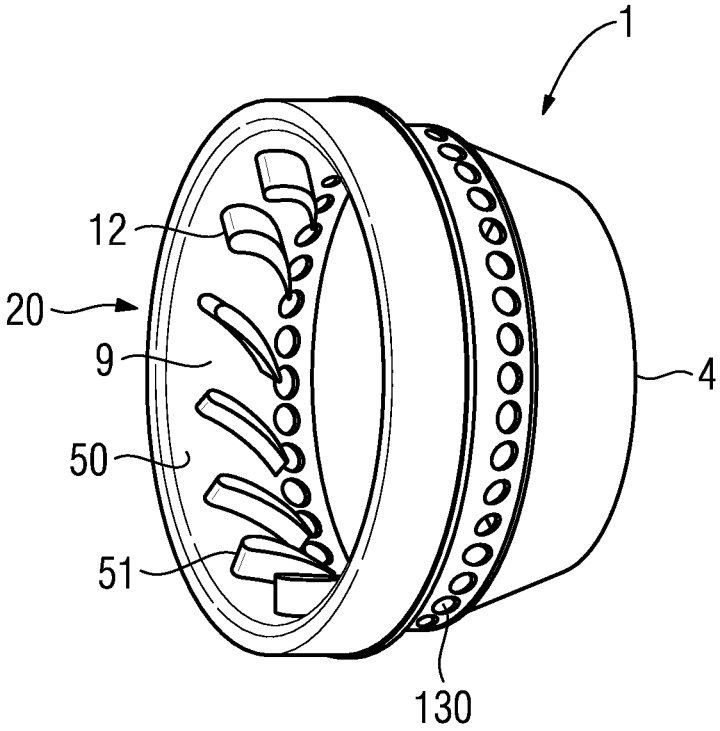
FIG. 2 shows a fuel nozzle according to the invention.

The fuel nozzle 1 has an annular wall 9 which is spaced radially apart from the secondary feed unit in the axial direction, such that a gap height h is formed by the annular wall 9 and secondary feed unit. In this arrangement the fuel nozzle 1 has an internal wall 50 directed toward the secondary feed unit, the internal wall 50 having annularly arranged blades 12 (FIG. 2). Alternatively the blades 12 can also be arranged on the external wall of the secondary feed unit (not shown). By the external wall of the secondary feed unit is understood in this context the external wall of the secondary feed unit directed toward the fuel nozzle. The fuel nozzle 1 additionally has a fuel nozzle inlet 20 and a fuel nozzle outlet 4. The effect of the blades 12 is to place the pressure loss at the fuel nozzle outlet 4. This has the advantage that a higher level of acoustic stability is established in the combustion zone 10, which is to say stability against the well-known humming in the combustion zone 10, than in the case of the nozzles of the burner according to the prior art. In this implementation the pressure loss can also be set by way of the velocity of the synthesis gas or, alternatively, the cross-section of the fuel nozzle outlet.

Downstream, the fuel nozzle 1 is embodied at least partially as cone-shaped.

On the upstream side the blades 12 have a blade leading edge 51, and on the opposite side a blade trailing edge 60. In this arrangement the blade leading edge 51 has an axial distance s to the fuel nozzle inlet 20. In this case the ratio of distance s to gap height h is greater than 1 and less than 4. This limitation of the distance s to the blades 12 in the axial direction prevents the formation of a significant boundary layer.

The fuel nozzle inlet 20 is implemented with a greater gap height h in order to maximize the acceptable available pressure loss in the nozzle 1. This results in maximum utilization of the acceptable pressure loss and the avoidance of parasitic pressure losses at the fuel nozzle outlet 4. Stable combustion is therefore established.

The fuel nozzle inlet 20 is furthermore rounded off, the rounded-off region having a fuel nozzle inlet radius Re. In this arrangement the rounded-off region points away from a fuel nozzle interior. The ratio of fuel nozzle inlet radius Re to gap height h is in this case greater than 0.2 and less than 0.8. This produces a uniform flow acceleration up to the blade leading edge 51, resulting in inflow pressure losses being minimized and a uniform flow profile being produced at the blades 12. Alternatively this can also be accomplished by means of a straight nozzle 1 having a straight fuel nozzle entry 20 at an angle <75° (not shown). In this case the blade leading edge 51 has the aforementioned upstream relative axial distance of approximately 1<s (distance)/h (gap height)<4 to the fuel nozzle inlet 20.

In contrast to existing solutions, therefore, the nozzle 1 is embodied in such a way that by reducing the gap height h at the fuel nozzle inlet 20 the axial velocity is already increased upstream of the blades 12 and a uniform acceleration of the gas up to the exit from the nozzle 1 is achieved. In this case the gap height h at the fuel nozzle outlet 4 amounts to between 0.1 h (gap height)/Ra<0.2, where Ra represents the external fuel nozzle radius Ra, such that a Mach number in the range 0.4<Ma<0.8 is maintained, thereby effecting a better acoustic decoupling of the fuel system from pressure fluctuations of the combustion chamber. An increase in scale of the mixing energy is additionally associated with the higher Mach number. Furthermore, mixing paths are minimized at the nozzle outlet 4 as a result of the smaller gap height h than in the case of the nozzles according to the prior art.

The blades 12 additionally have a blade pitch angle (FIG. 2). In this case that blade pitch angle should be chosen at which as high a swirl number S as possible is set, though without causing a flow separation at the blade trailing edge 60 and the hub 70, the swirl number S establishing the ratio between the rotary momentum flow and the axial momentum flow. In this context the hub 70 refers to that part of the secondary feed unit which is located at the axial grating 22 and which constitutes the internal boundary of the fuel nozzle 1 at the nozzle outlet 4. The swirl number S lies in this case in a range of greater than 1.2 and less than 1.7. At the same time the ratio of the radius Ri of the secondary feed unit to the external fuel nozzle radius Ra of the fuel nozzle 1 at the fuel nozzle outlet 4 must be maintained so as to be greater than 0.6 and less than 0.8. Since the swirl number S is dependent on the ratio Ri/Ra, maintaining the ratio causes the synthesis gas flow to continue to follow the contour of the fuel nozzle 1, without separating on the hub side.

The fuel-air mixture flowing through the axial grating 22 additionally has a tangential flow direction 100 (swirl). In the fuel nozzle 1, too, a tangential flow direction 110 is superimposed on the synthesis gas flow by means of a pitch angle of the blades 12. The blade pitch angle can now be arranged such that the tangential flow directions 100 and 110 now have an opposite direction of rotation. Toward that end the blades 12 and the axial grating 22 must have an opposite arrangement. This produces a considerable increase in the mixing intensity owing to the increased shear velocities in the contact zones of the flows 100 and 110. Because of the counterswirl the relative velocities between the air-fuel mixture and synthesis gas namely lie significantly above the relative velocities of an arrangement in the same direction, which in turn results in the considerably more intense mixing of the two flows. This in turn has a positive impact on the NOx emissions. The air flowing through the annular passage 40 also has a swirl 120. This is preferably in alignment with the swirl flow 100.

Viewed in the flow direction, the fuel nozzle 1 can also have holes 130 downstream of the blades 12. The air of the annular duct 40 can enter through said holes 130 when the burner is not operating in the synthesis gas mode. Thus, it is also possible to operate the burner without synthesis gas when fuel is supplied by way of the pilot burner or else when fuel is supplied by way of the natural gas passage 35. Accordingly, during operation without synthesis gas, no hot gas present in the combustion zone 10 can flow back via the nozzle 1. In this case the holes 130 can be embodied with an inflow shell (7) which projects into the duct 40. Thus, in operation without synthesis gas, the air L" can be made to flow in a more targeted manner through the holes 130 into the nozzle 1, thereby even more effectively preventing hot gas from flowing back out of the combustion zone 10 into the nozzle 1.

FIG. 2 shows a fuel nozzle 1 according to the invention in detail. Said nozzle 1 has an internal wall 50. The blades 12 are distributed in an annular arrangement over the circumference of the internal wall 50. The nozzle 1 is embodied in a cone shape and moreover over the entire area of the hub 70 (FIG.

1), thus resulting in a smaller gap height h (FIG. 1) at the fuel nozzle outlet 4 than is the case with the nozzles according to the prior art.

In contrast to the nozzle 1 of the burner according to the prior art, the volume flow of the synthesis gas which must be supplied to the combustion zone 10 through the burner according to the invention can be reduced while maintaining the same NOx emissions. This yields the advantage of a smaller installation space of the primary feed unit or, as the case may be, of the supply systems to the primary feed unit. The better acoustic stability allows an extended operating range of the burner according to the invention in terms of load and fuel quality.

The invention claimed is:

1. A turbine burner, comprising:

a secondary feed unit for supplying a secondary fuel or air and for discharging the secondary fuel or air from an orifice into a combustion zone; and a primary feed unit comprising a primary mixing tube and a fuel nozzle having a fuel nozzle outlet pointing into the combustion zone for supplying a primary fuel, wherein the fuel nozzle and the primary mixing tube are arranged concentrically around the secondary feed unit, wherein the primary mixing tube and the fuel nozzle have a fluid flow connection, wherein the fuel nozzle has an annular wall spaced radially apart from the secondary feed unit in an axial direction to form a gap height by the annular wall and the secondary feed unit, wherein the annular wall has an internal wall directed toward the secondary feed unit, wherein a fluid channel is between the secondary feed unit and the annular wall, wherein the fluid channel comprises blades each having a blade leading edge on an upstream side, wherein the fuel nozzle has a fuel nozzle inlet, wherein the each blade has an axial distance to the fuel nozzle inlet and a ratio of the axial distance to the gap height is greater than 1 and less than 4, and wherein the gap height is greater at the fuel nozzle inlet than downstream of the fuel nozzle inlet.

2. The turbine burner as claimed in claim 1, wherein the blades are annularly distributed over a circumference of the internal wall.

3. The turbine burner as claimed in claim 1, wherein the secondary feed unit has an external wall directed toward the fuel nozzle, and wherein the blades are annularly distributed over a circumference of the external wall.

4. The turbine burner as claimed in claim 1, wherein the fuel nozzle has at least a partial cone shape in a flow direction.

5. The turbine burner as claimed in claim 4, wherein the fuel nozzle has a continuous reduction in the gap height from the flow direction downstream of the blades.

6. The turbine burner as claimed in claim 1, wherein the fuel nozzle inlet is rounded off, and wherein the rounded-off region has a fuel nozzle inlet radius pointing away from a fuel nozzle internal path.

7. The turbine burner as claimed in claim 6, wherein a ratio of the fuel nozzle inlet radius to the gap height is greater than 0.2 and less than 0.8.

8. The turbine burner as claimed in claim 1, wherein the fuel nozzle has a fuel nozzle external radius.

9. The turbine burner as claimed in claim 8, wherein a ratio of the gap height at the fuel nozzle inlet to the fuel nozzle external radius is greater than 0.2 and less than 0.3.

10. The turbine burner as claimed in claim 8, wherein the secondary feed unit has a radius and a ratio of the radius to the fuel nozzle external radius of the fuel nozzle at the fuel nozzle outlet is greater than 0.6 and less than 0.8.

11. The turbine burner as claimed in claim 1, wherein the fuel nozzle has holes disposed downstream of the blades from a flow direction and arranged over a circumference of the annular wall of the fuel nozzle.

12. The turbine burner as claimed in claim 11, wherein the holes each has an inflow shell.

13. The turbine burner as claimed in claim 1, wherein an annular duct comprising a plurality of swirlers is arranged at least partially around the primary feed unit.

* * * * *

UNITED STATES PATENT AND TRADEMARK OFFICE

CERTIFICATE OF CORRECTION

PATENT NO. : 8,869,535 B2
APPLICATION NO. : 13/699801
DATED : October 28, 2014
INVENTOR(S) : Kock et al.

It is certified that error appears in the above-identified patent and that said Letters Patent is hereby corrected as shown below:

On the title page, items (12) and (75) Inventor #1 should read: Boris Ferdinand Kock Signed and Sealed this
Tenth Day of February, 2015

Michelle K. Lee

Michelle K. Lee
*Deputy Director of the United States Patent and Trademark Office*